US009861906B1

(12) United States Patent
Calvert

(10) Patent No.: US 9,861,906 B1
(45) Date of Patent: Jan. 9, 2018

(54) ELECTRICAL TOY BLOCK APPARATUS, SYSTEM, AND METHOD FOR MAKING THE SAME

(71) Applicant: Graham Calvert, Mobile, AL (US)

(72) Inventor: Graham Calvert, Mobile, AL (US)

( * ) Notice: Subject to any disclaimer, the term of this patent is extended or adjusted under 35 U.S.C. 154(b) by 0 days.

(21) Appl. No.: 15/427,639

(22) Filed: Feb. 8, 2017

(51) Int. Cl.

| | |
|---|---|
| ***A63H 33/04*** | (2006.01) |
| ***A63H 33/26*** | (2006.01) |
| ***H01R 25/00*** | (2006.01) |
| ***H01R 13/62*** | (2006.01) |

(52) U.S. Cl.
CPC ..... *A63H 33/042* (2013.01); *A63H 33/046* (2013.01); *A63H 33/26* (2013.01); *H01R 13/6205* (2013.01); *H01R 25/00* (2013.01)

(58) Field of Classification Search
CPC ..... A63H 33/00; A63H 33/04; A63H 33/042; A63H 33/046; A63H 33/26
USPC ..... 446/92, 129, 132, 137, 484
See application file for complete search history.

(56) References Cited

U.S. PATENT DOCUMENTS

| | | | | |
|---|---|---|---|---|
| 6,062,937 | A * | 5/2000 | Kikuchi | A63H 33/042 446/484 |
| 7,311,526 | B2 | 12/2007 | Rohrbach | |
| 7,322,873 | B2 * | 1/2008 | Rosen | A63H 33/042 446/124 |
| 7,708,615 | B2 * | 5/2010 | Munch | A63H 33/042 446/484 |
| 8,850,683 | B2 | 10/2014 | Haughey | |
| 8,851,953 | B2 * | 10/2014 | Oschuetz | A63H 33/042 446/124 |
| 9,266,032 | B2 | 2/2016 | Haughey | |

* cited by examiner

*Primary Examiner* — Kien Nguyen
(74) *Attorney, Agent, or Firm* — AdamsIP, LLC; Gary N. Stewart; Stephen Thompson

(57) ABSTRACT

An electrical toy block apparatus, system, and a method for making the same are provided. The electrical toy block has a housing block with a power supply housed within and an external terminal assembly for forming an electrical circuit within the electrical toy block. The electrical toy block is constructed by forming a pocket within the housing block, inserting the power supply within the pocket, securing the external terminal assembly to the housing, and connecting the external terminal assembly to the power supply in an electrically conductive relationship. The external terminal assembly of the electrical block is magnetic so that additional toy blocks can be attached to the housing block to form electrical circuits made up of various arrangements of toy blocks. An external device may then be connected to the circuit to power the external device.

17 Claims, 7 Drawing Sheets

ELECTRICAL TOY BLOCK APPARATUS, SYSTEM, AND METHOD FOR MAKING THE SAME

FIELD OF THE DISCLOSURE

The present invention refers generally to an electrical toy block apparatus, system, and a method for making the same.

BACKGROUND

Toy blocks are frequently provided to children to promote motor and cognitive development. Traditional toy blocks generally rely on the force of gravity to maintain a stacked arrangement, and therefore inherently limit the structures and block arrangements a child can construct. Throughout the years, traditional toy blocks have been modified to enable the construction of more complex physical structures by incorporating structural features such as interlocking mechanical members on the surface the block. However, most commercially available toy blocks generally lack any type of electrical component therein to facilitate simple construction and promote cognitive understanding of electrical circuits and systems. Thus, known toy blocks are generally incapable of forming either an open or closed electrical circuit to which an external electrical device can be powered by connecting the external device to the circuit formed by the toy blocks. In this way, known toy blocks or toy block systems are generally not suitable for promoting cognitive understanding of electrical circuits and systems among young children.

Accordingly, there is a need in the art for an electrical toy block apparatus and system for generating and conducting electricity and for forming an electrical circuit that can be used to power an external electrical device using only toy blocks. Moreover, there is a need in the art for an electrical toy block system that can be used by children to form electrical circuits made up of various arrangements of toy blocks.

SUMMARY

In one aspect, an electrical toy block configured to generate and conduct electricity therethrough and a method for making the same are provided. In a preferred embodiment, the electrical toy block is designed to create an open electrical circuit, which may be extended or closed by adjoining peripheral blocks to the electrical toy block in an electrically conductive fashion. The electrical toy block comprises a housing block, a power supply, and an external terminal assembly. The housing block defines the general shape of the electrical toy block and houses the power supply therein. In a preferred embodiment, the housing block comprises a first half and second half configured for removably securing the halves together via magnetic attraction between a first internal terminal and a second internal terminal secured to the first half and the second half of the housing block, respectively. The external terminal assembly is secured to the exterior of the housing block and is electrically connected to the power supply such that the external terminal assembly functions as an electrical contact through which electricity generated from electrical toy block may be transmitted to other toy blocks or to an electrically powered external device.

In a preferred embodiment, the power supply is a battery having a cathode and anode end, and the external terminal assembly comprises a first external terminal and a second external terminal. By electrically connecting the first external terminal to the cathode of the power supply and the second external terminal to the anode of the battery, or vice versa, an open electrical circuit may be established within the electrical toy block. To extend or close the electrical circuit within the electrical toy block, suitable peripheral blocks may be adjoined to the external terminal assembly in an electrically conductive relationship. To facilitate adjoining of peripheral blocks, the external terminal assembly is at least partially magnetized such that other magnets or ferromagnetic objects may be secured to the external terminal assembly via magnetic attraction.

In another aspect, the present disclosure is directed to an electrical toy block system comprising the electrical toy block and one or more peripheral blocks, referred to herein as connector blocks. Connector blocks generally comprise a housing and an input terminal assembly secured to the housing. The input terminal assembly is at least partially magnetic such that the input terminal assembly and the external terminal assembly of the electrical toy block can be removably secured together via magnetic attraction. The input terminal assembly is configured to conduct electricity in order to facilitate the transfer of electricity from the electrical toy block to the connector block. Accordingly, once the input terminal assembly of the connector block and the external terminal assembly of the electrical toy block are secured, electricity generated within the electrical toy block may be transferred to the connector block. The connector block further comprises an output terminal assembly electrically connected to the input terminal assembly and configured to conduct electricity received therefrom. Thus, the output terminal assembly of the connector block may serve as an electrical contact to which additional connector blocks may be adjoined or to which an external device may be connected for powering the external device.

The foregoing summary has outlined some features of the device, system and methods of the present disclosure so that those skilled in the pertinent art may better understand the detailed description that follows. Additional features that form the subject of the claims will be described hereinafter. Those skilled in the pertinent art should appreciate that they can readily utilize these features for designing or modifying other structures for carrying out the same purposes of the device and methods disclosed herein. Those skilled in the pertinent art should also realize that such equivalent designs or modifications do not depart from the scope of the device and methods of the present disclosure.

DESCRIPTION OF DRAWINGS

These and other features, aspects, and advantages of the present disclosure will become better understood with regard to the following description, appended claims, and accompanying drawings where:

DETAILED DESCRIPTION

Figure 1:
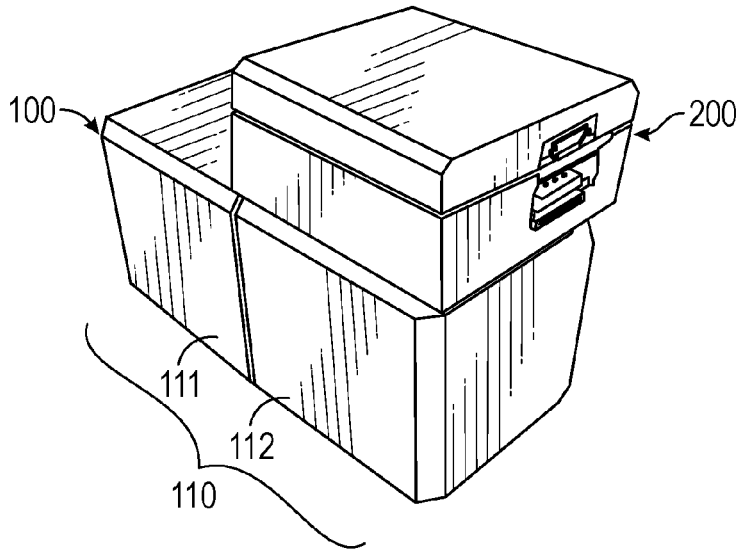
FIG. 1 shows a perspective view of an electrical toy block system embodying features consistent with the present disclosure.

In the Summary above and in this Detailed Description, and the claims below, and in the accompanying drawings, reference is made to particular features, including method steps, of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with/or in the context of other particular aspects of the embodiments of the invention, and in the invention generally.

The term "comprises" and grammatical equivalents thereof are used herein to mean that other components, steps, etc. are optionally present. For example, a system "comprising" components A, B, and C can contain only components A, B, and C, or can contain not only components A, B, and C, but also one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility). The term "removably secured" and grammatical equivalents thereof are used herein to mean the joining of two components in a manner such that the two components are secured together, but may be detached from one another without requiring the use of specialized tools.

Turning now to the drawings, FIGS. 1-10 illustrate preferred embodiments of an electrical toy block apparatus and system. In one aspect, an electrical toy block apparatus 100 designed to generate and transfer electricity therethrough is provided. A housing block 110 defines the general geometric shape of the electrical toy block 100. In a preferred embodiment, the housing block 110 comprises a first half 111 and a second half 112 which removably secure together to house a power supply 130 therein. The power supply 130 is electrically connected to an electrically conductive external terminal assembly 120 in order to establish an electrical contact from which electricity generated by the electrical toy block 100 may be transferred to other toy blocks, referred to herein as connector blocks 200. In a preferred embodiment, the power supply 130 is a battery and the external terminal assembly 120 comprises a first external terminal 121 and a second external terminal 122. By electrically connecting the first external terminal 121 to the cathode of the power supply 130 and electrically connecting the second external terminal 122 to the anode of the power supply 130, or vice versa, an open electrical circuit is established within the electrical toy block 100. To extend or close the electrical circuit within the electrical toy block 100, one or more connector blocks 200 may be adjoined to the external terminal assembly 120 in an electrically conductive relationship.

The external terminal assembly 120 is at least partially magnetized such that other magnets or ferromagnetic materials may be attracted thereto to facilitate adjoining of a connector block 200 to the electrical toy block 100. For instance, a connector block 200 having a magnetic input terminal assembly 220 may be adjoined to the electrical toy block 100 in an electrically conductive relationship via magnetic attraction between the external terminal assembly 120 and the input terminal assembly 220, as illustrated in FIG. 1. Accordingly, the electrical circuit of the electrical block 100 may be extended or closed by the connector block 200, depending on the configuration of the connector block 200. Once a closed circuit is established, electricity generated by the electrical block 100 may be transferred from electrical block 100 via the external terminal assembly 120 to the connector block 200 via the input terminal assembly 220. Thus, in another aspect, the present disclosure is directed towards an electrical block system.

Figure 2:
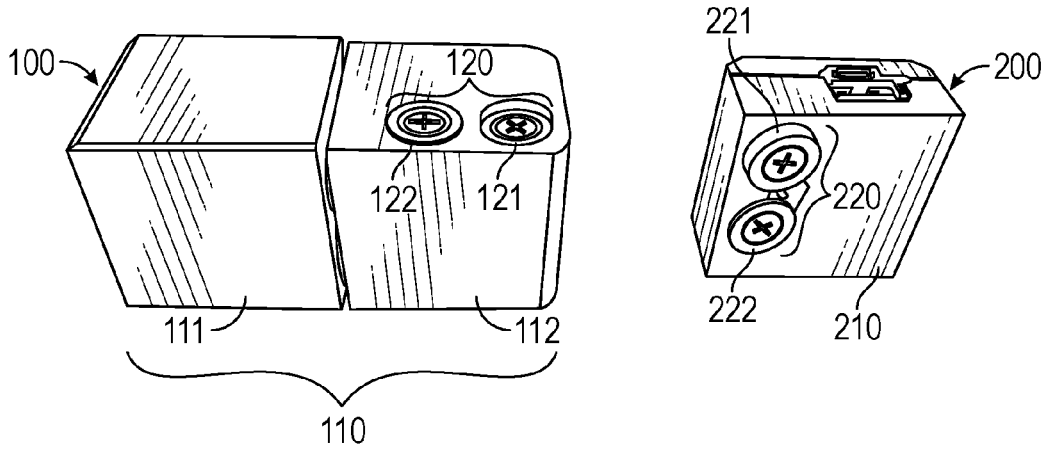
FIG. 2 shows perspective view of an electrical toy block apparatus and a connector block embodying features consistent with the present disclosure.
Figure 4:
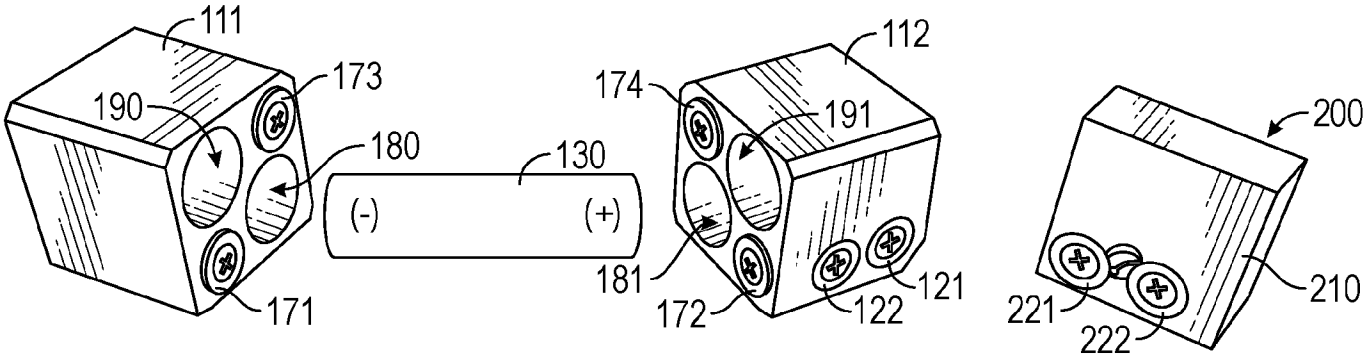
FIG. 4 shows a perspective view of a disassembled electrical toy block system embodying features consistent with the present disclosure.

As best shown in FIG. 4, the electrical toy block 100 comprises: a housing block 110; an external terminal assembly 120 secured to the exterior of the housing block 110, wherein the external terminal assembly 120 is at least partially magnetized; and a power supply 130, wherein the power supply 130 is housed within the housing block 110 and is electrically connected to the external terminal assembly 120. The housing block 110 of the electrical toy block 100 has one or more faces which define the general shape of the electrical toy block 100. For purposes of the present disclosure, the surface of a sphere is considered to constitute a face. To maintain the shape of the electrical toy block 100, the housing block 110 is preferably made of a rigid or semi-rigid material. As shown in FIGS. 1-2, the housing block 110 is of a rectangular cuboid shape in order to provide a large surface area to which peripheral connector blocks 200 may be adjoined. However, the housing block 110 may be cubed, pyramidal, conical, spherical, or any other suitable shape for housing a power supply 130 therein and securing an external terminal assembly 120 thereto. In a preferred embodiment, the housing block 110 is made at least partially of wood for aesthetic purposes and due to the non-conductive nature of wood. However, one skilled in the art should appreciate that that the housing block 110 may be made of any suitable material, such as plastic or stone.

To house the power supply 130, a pocket is formed within the housing block 110 by boring a hole of sufficient depth and diameter in a face of the housing block 110 such that the power supply 130 may be inserted therein. The housing block 110 preferably comprises a first half 111 and a second half 112, as shown in FIGS. 1-4. Alternatively, the housing block 110 may comprise a single piece of material. The dimensions of the first half 111 and the second half 112 of the housing 110 may be the same or varied. As best seen in FIG. 4, the pocket for housing the power supply 130 therein may be formed by boring a first hole 180 into an interior face of the first half 111 of the housing block 110 and boring a second hole 181 into an interior face of the second half 112 of the housing block 110. Preferably, the first hole 180 and second hole 181 are of a sufficient diameter and depth to accommodate the dimensions of the power supply 130 such that the power supply 130 is substantially encased within the housing block 110 when inserted into the first and second holes 180 and 181, as illustrated in FIGS. 1-2. The holes preferably do not extend entirely through the housing block 110 such that the power supply 130 is secured within the housing block 110.

In a preferred embodiment, a second pocket may be formed within the housing block 110 to provide a storage compartment within the electrical toy block 100. The second pocket may be formed by boring a third hole 190 adjacent the first hole 180 and boring a fourth hole 191 adjacent the second hole 181, as illustrated in FIGS. 3-5B. In a preferred embodiment, the third hole 190 and the fourth hole 191 are of a sufficient diameter and depth to accommodate the dimensions of a spacer (not shown), such as a dowel rod, such that the spacer is substantially encased within the housing block 110 when inserted in the third hole 190 and fourth hole 191.

Figure 3:
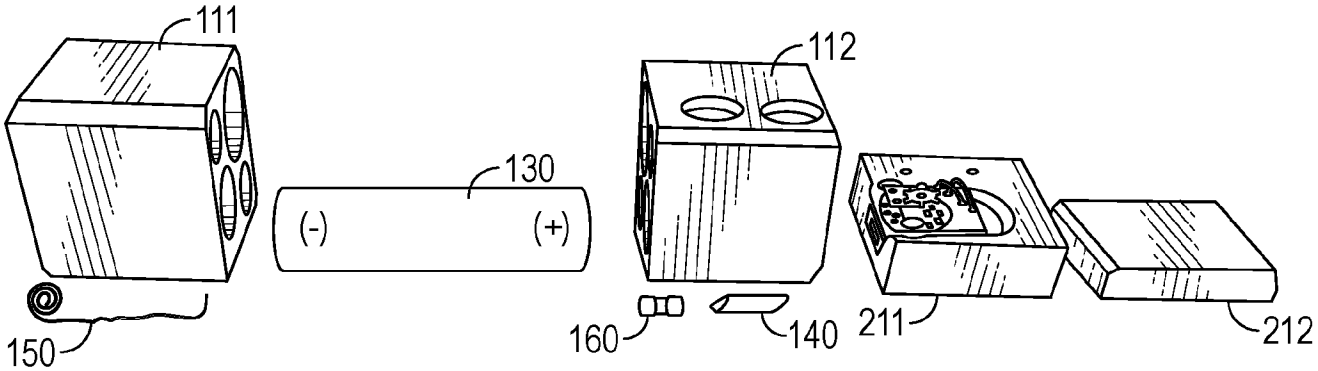
FIG. 3 shows a perspective view of a disassembled electrical toy block system embodying features consistent with the present disclosure.

As shown in FIGS. 3-4, the power supply 130 is preferably a battery having a cathode and anode end. The battery may be a primary or secondary cell battery. Preferably, the power supply 130 is a dry cell battery. Alternatively, the power supply 130 may be a wet cell battery. The dimensions of the power supply 130 are preferably such that when the power supply 130 is inserted into the pocket of the housing block 110, the power supply 130 is substantially encased within the housing 110, as best shown in FIG. 2.

Figure 5A:
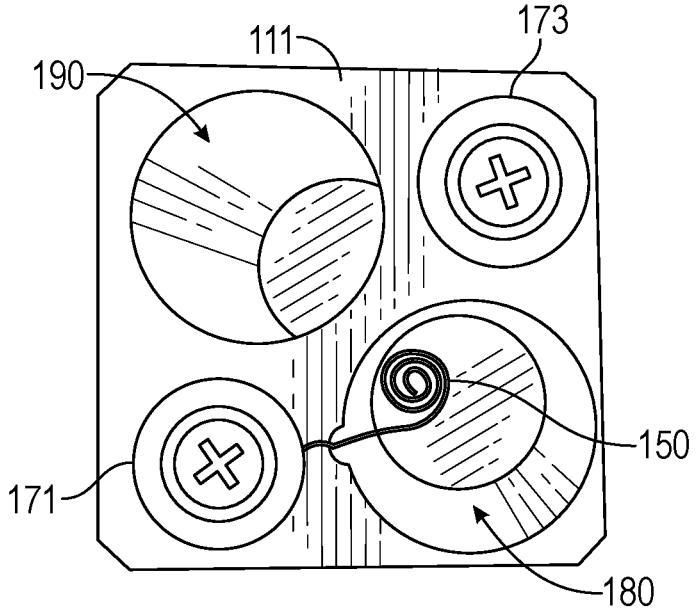
FIG. 5A shows a side elevational view of a first half of an electrical toy block apparatus embodying features consistent with the present disclosure.
Figure 5B:
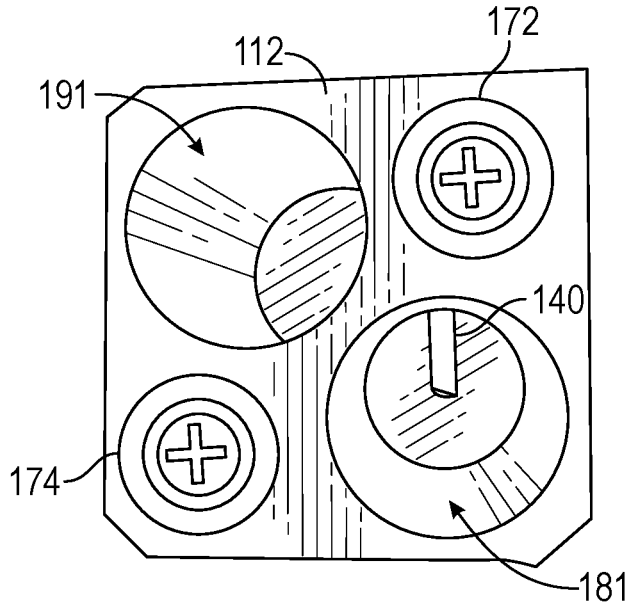
FIG. 5B shows a side elevational view of a second half of an electrical toy block apparatus embodying features consistent with the present disclosure.

To ensure the power supply 130 remains in place and to ensure that the electrical connection between the power supply 130 and the external terminal assembly 120 remains intact during use, the first half 111 and the second half 112 of the housing block 110 are configured to be secured together. In a preferred embodiment, the first half 111 and second half 112 of the housing block 110 are configured to be removably secured together via magnetized internal terminals secured to an interior face of each half. As shown in FIGS. 4-5B, a first internal terminal 171 is secured to an interior face of the first half 111, and a second internal terminal 172 is secured to an interior face of the second half 112. Preferably, the first internal terminal 171 is secured adjacent the first hole 180 and the second internal terminal 172 is secured adjacent the second hole 181. However, one skilled in the art should appreciate that the first and second halves of the housing block 110 may be secured together in any suitable manner.

The first and second internal terminals 171 and 172 each preferably have an outer face exhibiting a magnetic polarity. The magnetic polarity exhibited by the outer face of the first internal terminal 171 is opposite the magnetic polarity exhibited by the outer face of the second internal terminal 172 such that the first half 111 and second half 112 of the housing block 110 can be removably secured via magnetic attraction between the first internal terminal 171 and second internal terminal 172. For instance, the first internal terminal 171 may exhibit a north polarity and the second internal terminal 172 may exhibit a south polarity, or vice versa. As used herein, the outer face of an internal terminal is understood to be the portion of the internal terminal which faces outward from an interior face of the first half 111 or the second 112 half of the housing block 110.

To establish a magnetic polarity within the internal terminals 171,172 such that the outer face of each internal terminal exhibits a magnetic polarity, the internal terminals 171,172 preferably comprise a magnetic element 620. The magnetic element 620 produces a magnetic field such that one side or end of the magnetic element 620 exhibits a north polarity and the other side or end of the magnetic element 620 exhibits a south polarity. Accordingly, the magnetic polarity exhibited by the outer face of each internal terminal 171,172 is determined by the manner in which the magnetic element 620 is secured to the housing block 110. For instance, if the magnetic element 620 of an internal terminal has a first side exhibiting a north polarity and a second side exhibiting a south polarity and the second side of the magnetic element is secured to a face of the housing 110, the outer face of the internal terminal will exhibit a north polarity.

Figure 6:
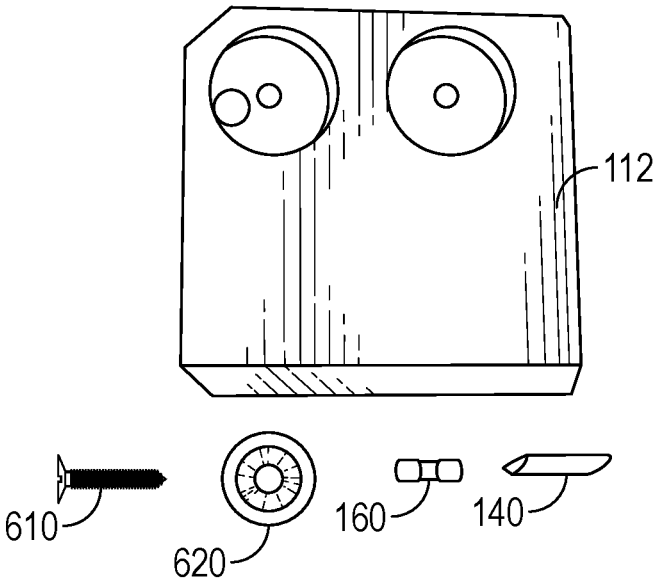
FIG. 6 shows a top perspective view of a partially disassembled second half of an electrical toy block apparatus embodying features consistent with the present disclosure.

Preferably, the magnetic element 620 is a permanent rare earth magnet, as shown in FIG. 6. Alternatively, the magnetic element 620 may be an electromagnet. In a preferred embodiment, the magnetic element 620 is a permanent magnet having an opening therein of sufficient diameter such that a conducting element 610 (discussed below) may pass substantially therethrough, as shown in FIG. 6. One of skill in the art will appreciate that the magnetic element 620 may be any object that produces a magnetic field therefrom including, but not limited to, magnetized screws, screws having a magnetic head, magnetized nails, or nails having a magnetic head.

To further secure the first half 111 to the second half 112, additional magnetic terminals may be secured to the interior faces of the halves of the housing block. As shown in FIGS. 4-5B, a third internal terminal 173 may be secured to an interior face of the first half 111 of the housing block 110, and a fourth internal terminal 174 may be secured to an interior face of the second half 112 of the housing block 110. In a preferred embodiment, the third internal terminal 173 may be secured adjacent the third hole 190, and a fourth internal terminal 174 may be secured adjacent the fourth hole 191.

Preferably, the third and fourth internal terminals 173, 174 each have an outer face exhibiting a magnetic polarity. The magnetic polarity of the outer face of the third internal terminal 173 is preferably opposite the magnetic polarity exhibited by the outer faces of the first and fourth internal terminals 171, 174, and the magnetic polarity of the face of the fourth internal terminal 174 is preferably opposite the magnetic polarity exhibited by the outer faces of the second and third internal terminals 172, 173. For instance, the outer face of first internal terminal 171 may exhibit a north polarity, the outer face of the second internal terminal 172 may exhibit a south polarity, the outer face of the third internal terminal 173 may exhibit a south polarity, and the outer face of the fourth internal terminal 174 may exhibit a north polarity. Alternating the magnetic polarity exhibited by the faces of the internal terminals in this way serves to limit the possible orientations to which the first half 111 and second half 112 of the housing 110 may be secured together, thereby reducing the risk of the electrical toy block 100 being assembled in an inoperable orientation. One of skill in the art, however, should appreciate that the polarity exhibited by the outer face of the internal terminals 171-174 may be of any suitable orientation such that the first internal terminal 171 can be removably secured to the second internal terminal 172 and the third internal terminal 173 can be removably secured to the fourth internal terminal 174 via magnetic attraction. Although it is generally preferred that the first half 111 and second half 112 of the housing 110 be secured together magnetic internal terminals 171, 172, other fastening or securing devices suitable for removably securing one object to another object may be used including, but not limited to, snap buttons, hook and loop fasteners (e.g., Velcro), adhesive tapes, screws, nails, nails and bolts, or any similar types of fasteners. Moreover, although it is generally preferred that the first half 111 and the second half 112 of the housing 110 be removably secured, in alternative embodiments the first half 111 and second half 112 may be permanently secured via adhesives or otherwise.

An electrical circuit is established within the electrical toy block 100 by electrically connecting the power supply 130 to an external terminal assembly 120 secured to the exterior of the housing block 110. To facilitate the transfer of electricity from the electrical block 100 to other peripheral connector blocks 200, the external terminal assembly 120 is configured to conduct electricity generated from the power supply 130, and therefore may comprise any suitable electrically conductive material. In a preferred embodiment, the external terminal assembly 120 comprises a first external terminal 121 and a second external terminal 122, as shown in FIGS. 2 and 4, wherein both the first and second external terminals 121, 122 are electrically connected to the power supply 130. In a preferred embodiment, wherein the power supply 130 is a battery, an open electrical circuit is established within the electrical toy block 100 by electrically connecting the first external terminal 121 to the cathode end of the battery and electrically connecting the second external terminal 122 to the anode end of the battery. In alternative embodiments, the external terminal assembly 120 may comprise a single electrically conductive component electrically connected to the power supply 130, thereby establishing a closed circuit within the electrical toy block 100.

To facilitate the transfer of electricity from the electrical toy block 100 to a connector block 200 or an external device, the first and second external terminals 121, 122 may further comprise a conducting element 610. The conducting element 610 is configured to permit electrical current to pass therethrough and may comprise any suitable electrically conductive material. For instance, the conducting element 610 may be a metallic screw, as shown in FIG. 6. Alternatively, the conducting element 610 may be a nail, a bolt, an electrical wire, an electrical pin, a magnet, or any other similar conductive material.

The external terminal assembly 120 is at least partially magnetized such that other magnets or ferromagnetic materials may be attracted to the external terminal assembly 120 to facilitate adjoining of peripheral blocks. Preferably, the first and second external terminals 121, 122 each have an outer face exhibiting a magnetic polarity, wherein the outer face of the first and second external terminals 121, 122 is understood to be the portion of the external terminals that is environmentally exposed when the external terminal is secured to the exterior of the housing block 110. In such embodiments, the first and second external terminals 121, 122 further comprise a magnetic element 620, as disclosed above, which serves to secure magnetic peripheral blocks or objects to the electrical toy block 100 via magnetic attraction. The magnetic element 620 preferably has an opening therein of sufficient diameter such that a conducting element 610 may pass substantially therethrough. Accordingly, in embodiments wherein the conducting element 610 is a metallic screw, the screw may pass through the opening of the magnetic element 620 to secure the magnetic element to the housing block 110.

As with internal terminals 171-174, the magnetic element 620 of the external terminals 121, 122 produces a magnetic field such that one side or end of the magnetic element 620 exhibits a north polarity and the other side or end of the magnetic element 620 exhibits a south polarity. The magnetic element 620 of the first and second external terminals 121, 122 may be secured to the housing block 110 in the same manner disclosed above for internal terminals 171-174 to control the magnetic polarity exhibited by the outer face of the first and second external terminals 121, 122. In a preferred embodiment, the magnetic polarity exhibited by the outer face of the first external terminal 121 is opposite of the magnetic polarity exhibited by the outer face of the second external terminal 122 to limit the possible orientations in which a peripheral block may be adjoined to the electrical toy block 100. Alternatively, the magnetic polarity exhibited by the outer face of the first and second external terminals 121, 122 may be the same.

In a preferred embodiment, the conducting element 610 and the magnetic element 620 are two separate components. However, in alternative embodiments, the conducting element 610 and the magnetic element 620 may be a single component. For instance, a magnetized screw, a screw with a magnetic head, or a magnet may serve as both the conducting element 610 and the magnetic element 620. One or more portions of the housing block 110 may be recessed or have holes drilled therein to accommodate first and second external terminals 121, 122, as shown on the top face of the second half 112 of the housing 110 in FIGS. 3 and 6.

Each of the first and second external terminals 121 and 122 of the external terminal assembly 120 may be secured to the same face of the housing block 110, as shown in FIGS. 2 and 4, or to separate faces of the housing block. For instance, the housing block 110 may comprise a plurality of faces, and the first and second external terminals 121 and 122 may respectively be secured to adjacent or opposing faces of the housing block 110, thereby diverting the electrical pathway extending from the power supply 130 to the external terminal assembly 120 in different directions. To ensure that connector blocks may be joined to the external terminal assembly 120, it is preferred that the external terminal assembly 120 not be secured to a face of the housing 110 to which an internal terminal 171, 172 is secured.

Depending on the orientation of the power supply 130 within the housing block 110, the first external terminal 121 may be electrically connected to the power supply 130 by either a first contact 140 or a second contact 150. As shown in FIG. 3, the first contact 140 is preferably a conductive metal wire or rod and the second contact 150 is preferably a coiled spring having an elongated arm, although any suitable electrical contact may be used for the first and second contacts 140, 150. In a preferred embodiment, the power supply 130 is a battery and is oriented within the housing block 110 such that the anode end of the power supply 130 is housed within the first hole 180 of the housing block 110 and the cathode end of the power supply 130 is housed within the second hole 181 of the housing block 110. The first contact 140 is disposed within the second hole 181 of the housing block 110, as shown in FIG. 5B, and is electrically connected to the first external terminal 121. To facilitate electrical contact between the first contact 140 and the first external terminal 121, the housing block 110 has an opening that extends from the second hole 181 to the external face of the housing block 110 to which the first external terminal 121 is secured. The first contact 140 extends through the opening from the first external terminal 121 into the second hole 181.

The second external terminal 122 is preferably electrically connected to the power supply 130 via the first internal terminal 171 and the second internal terminal 172, which contact each other when the two halves 111 and 112 of the housing block 110 are secured together. To this end, the first and second internal terminals 171, 172 may further comprise a conducting element 610, as disclosed above. Preferably, the conducting element 610 and the magnetic element 620 are two separate components. However, in alternative embodiments, the conducting element 610 and the magnetic element 620 may be a single component. For instance, a magnetized screw, a screw with a magnetic head, or a magnet may serve as both the conducting element 610 and the magnetic element 620. The second contact 150 is disposed within the first hole 180 of the housing block 110 and contacts the first internal terminal 171, as shown in FIG. 5A, such that an electrical current produced from the power supply 130 may pass through the second contact 150 to the first internal terminal 171.

The electrical current received by the first internal 171 may be transferred to the second internal terminal 172 by adjoining the first half 111 and the second half 112 of the housing block 110 such that the outer faces of the first and second internal terminals 171, 172 are in electrical contact with each other. In a preferred embodiment, the magnetic attraction between the first and second internal terminals 171, 172 serves to hold the first and second internal terminals 171, 172 together in an electrically conductive relationship. To transfer the electrical current received by the second internal terminal 172 to the second external terminal 122, the second internal terminal 172 is electrically connected to the second external terminal 122. In a preferred embodiment, electrical contact is maintained via the conducting elements 610 of the second internal terminal 172 and the second external terminal 122. For instance, where metallic screws are utilized as the conducting elements 610, the metallic screw of the second internal terminal 172 and the metallic screw of the second external terminal 122 may be secured to the housing block 110 such that the two screws physically contact one another. Alternatively, electrical contact between the second internal terminal 172 and the second external terminal 122 may be established using electrical wire or other suitable conducting material, which may be directly connected to the magnetic element 620 of the terminals. To prevent excessive current within the electrical toy block 100, a fuse 160 may be implemented in the electrical pathway between the first external terminal 121 and the power supply 130, the second external terminal 122 and the power supply 130, or both.

Although it is preferred that the first and second external terminals 121, 122 be electrically connected to the power supply 130 in the manner described above, one of skill in the art should appreciate that the first and second external terminals 121, 122 may be electrically connected to the power supply 130 in any suitable manner without departing from the scope of the present disclosure.

Once the external terminal assembly 120 is electrically connected to the power supply 130, an open or a closed electrical circuit may be established, depending on the configuration of the external terminal assembly 122. The electrical circuit within the electrical toy block 100 may be extended or closed by adjoining one or more connector blocks 200 to the electrical toy block 100 via the external terminal assembly 120. Accordingly, an electrical block system comprising an electrical toy block 100 and one or more connector blocks 200 is provided. The electrical toy block 100 may be sold as a single, preassembled apparatus or may be sold as a kit containing some or all of the various structural components disclosed herein. Additionally, the electrical toy block 100 may be sold as a separate apparatus compatible with connector blocks 200, or as a component of an electrical block system comprising one or more connector blocks 200, which may come in various shapes and configurations.

Figure 7:
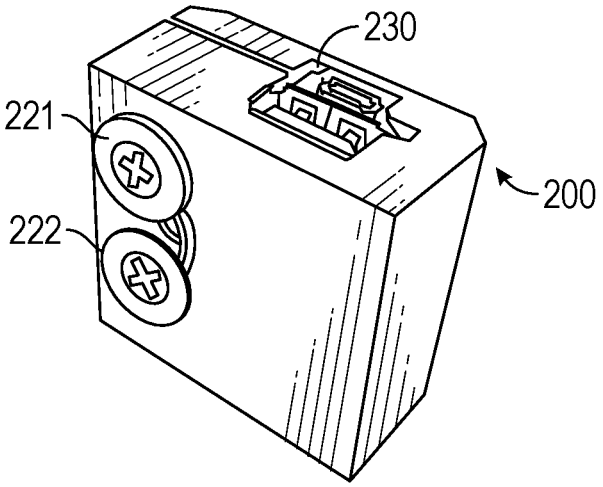
FIG. 7 shows a perspective view of a connector block embodying features consistent with the present disclosure.
Figure 8:
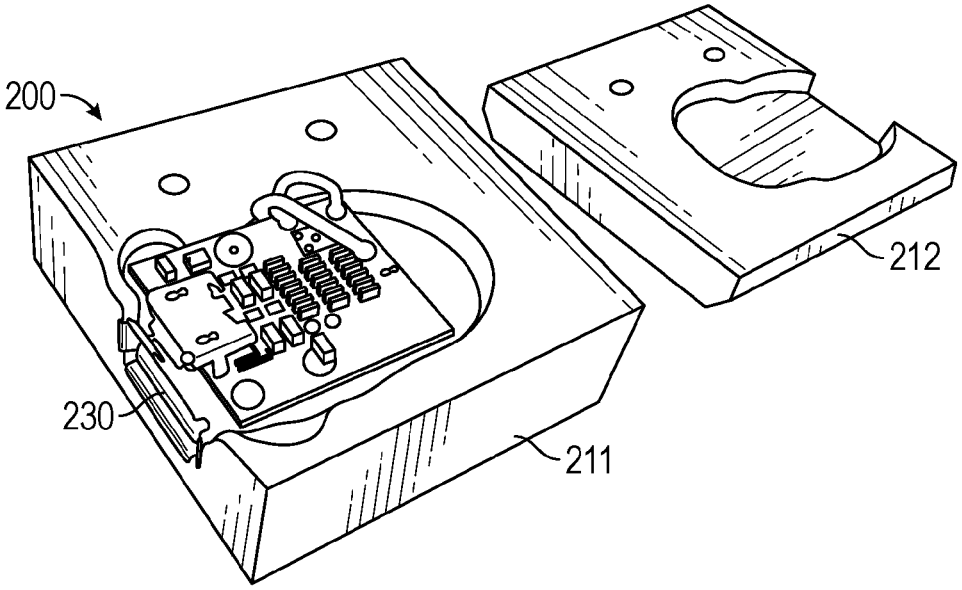
FIG. 8 shows a perspective view of a partially disassembled connector block embodying features consistent with the present disclosure.
Figure 10:
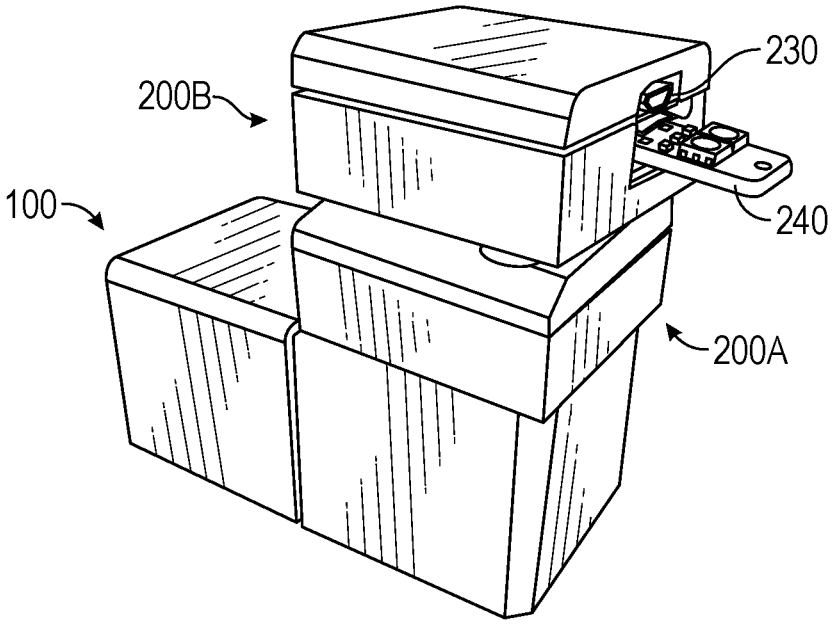
FIG. 10 shows a perspective view of an electrical toy block system embodying features consistent with the present disclosure, shown with an external device connected to the toy block system.

As shown in FIGS. 1-2 and FIG. 10, the system comprises an electrical toy block 100 and one or more connector blocks 200. Each connector block 200 comprises a housing 210, an input terminal assembly 220, and an output terminal assembly 230. The input terminal assembly 220 is electrically connected to the output terminal assembly 230 for forming an electrical circuit made up of the electrical toy block 100 and one or more connector blocks 200. In a preferred embodiment, the input terminal assembly 220 is at least partially magnetized such that the connector block 200 can be removably secured to the electrical toy block 100 by securing the input terminal assembly 220 to the external terminal assembly 120 of the electrical toy block 100 by magnetic attraction, as shown in FIGS. 1 and 10. The housing 210 defines the geometric shape of the connector block 200, and, as best shown in FIG. 8, may comprise a first half 211 and a second half 212 in order to accommodate and facilitate easy access to electrical components which may be housed within the housing 210. As shown in FIGS. 2 and 7, the input terminal assembly 220 preferably comprises a first input terminal 221 and a second input terminal 222. Alternatively, the input terminal assembly 220 may comprise a single terminal.

The input terminal assembly 220 is at least partially magnetized such that the input terminal assembly 220 and the external terminal assembly 120 of the electrical toy block 100 can be removably secured in an electrically conductive relationship via magnetic attraction. In a preferred embodiment, the first and second input terminals 221, 222 each have an outer face exhibiting a magnetic polarity, wherein the outer face of the first and second input terminals 221, 222 is understood to be the portion of the input terminal that removably secures to the external terminal assembly 120 of the electrical block 100. The first and second input terminal 221, 222 comprise a magnetic element 620, as disclosed above, that generates a magnetic field therefrom. As with the internal and external terminals disclosed above, the magnetic polarity exhibited by the outer face of the first and second input terminals 221, 222 may be controlled by the configuration in which the magnetic element 620 is secured to the housing 210.

In a preferred embodiment, the magnetic polarity exhibited by the outer face of the first input terminal 221 is opposite of the magnetic polarity exhibited by the outer face of the second input terminal 222. Alternatively, the magnetic polarity exhibited by the outer face of the first and second input terminals 221, 222 may be the same. In a preferred embodiment, the first input terminal 221 is configured to be removably secured to the first external terminal 121, and the second input terminal 222 is configured to be removably secured to the second external terminal 122. Alternatively, the first input terminal 221 may be configured to be removably secured to the second external terminal 122, and the second input terminal 222 may be configured to be removably secured to the first external terminal 121. To ensure the input terminal assembly 220 can be magnetically secured to the external terminal assembly 120, the magnetic polarity exhibited by the outer face of each input terminal 221, 222 is preferably opposite of the magnetic polarity exhibited by the outer face of the corresponding external terminal 121, 122 to which it is secured. Accordingly, to utilize the system, the input terminal assembly 220 is adjoined to the external terminal assembly 120 of the electrical toy block 100 in an electrically conductive manner, thereby allowing any electrical current passing through the electrical toy block 100 to be transferred to the connector block 200.

In order to conduct electricity received from the electrical toy block 100, the first and second input terminals 221, 222 may further comprise a conducting element 610 configured to permit electrical current to pass therethrough. In a preferred embodiment, the conducting element 610 is a metallic screw, although any electrically conductive object or material may be used. Alternatively, the magnetic element 620 of the first and second input terminals 221, 222 may be configured to conduct electricity received from the electrical toy block 100 and therefore serve as the conducting element 610.

Figure 9A:
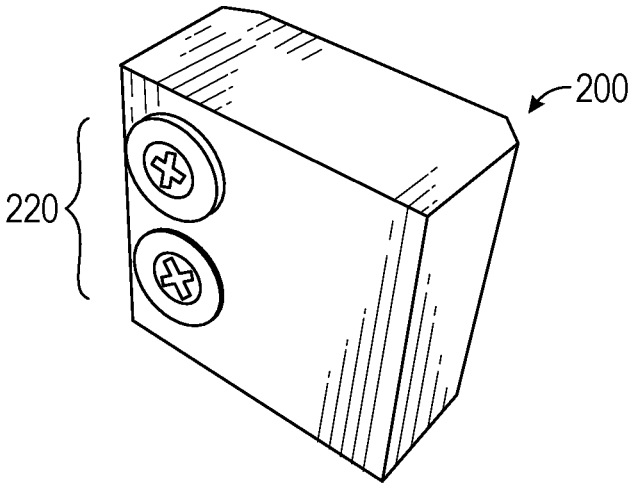
FIG. 9A shows a perspective view of a connector block embodying features consistent with the present disclosure.
Figure 9B:
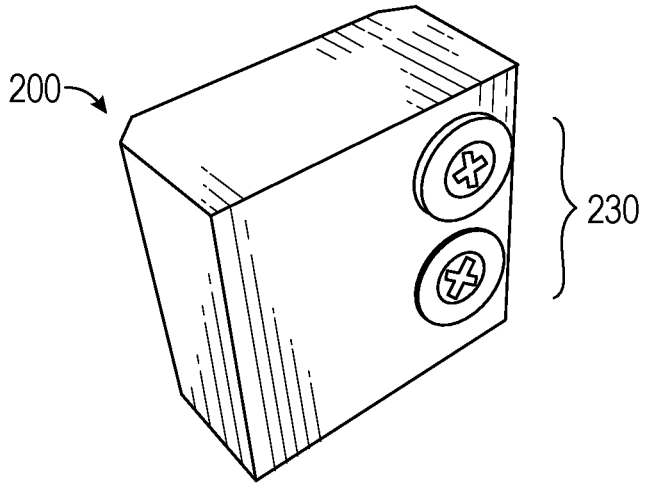
FIG. 9B shows a perspective view of a connector block embodying features consistent with the present disclosure.

FIGS. 7, 9A, and 9B illustrate assembled connector blocks 200. Each connector block 200 further comprises an output terminal assembly 230 electrically connected to the input terminal assembly 220, preferably via electrical wires housed within the connector block 200, and configured to conduct electricity received therefrom. Once a connector block 200 is secured to the electrical toy block 100, the output terminal assembly 230 of the connector block 200 may be utilized for securing an additional connector block 200 thereto, or may be utilized for connecting an external device 240 thereto for powering the device 240. FIG. 9A shows a connector block 200 comprising an input terminal assembly 220, and FIG. 9B shows the same connector block 200 comprising an output terminal assembly 230 on the opposite side of the connector block 200. As shown in FIG. 9B, the output terminal assembly 230 may be arranged in a similar fashion as the input terminal assembly 220, wherein the output terminal assembly 230 comprises a first and a second output terminal. In a preferred embodiment, the output terminal assembly 230, as shown in FIG. 9B, is at least partially magnetized such that the input terminal assembly 220 of an additional connector block 200, such as connector block 200B shown in FIG. 10, may be secured thereto via magnetic attraction. Thus, the connector block 200 may function to extend the electrical circuit of the electrical toy block 100 by providing an electrical pathway from the electrical toy block 100 to other connector blocks.

Alternatively, as shown in FIGS. 7 and 10, the output terminal assembly 230 may be a universal serial bus (USB) or similar type of connection to which an electrically powered external device 240 can be connected in order to supply electrical power to the device 240 from the power source 130. FIG. 10 illustrates an electrical toy block 100 with two connector blocks 200 secured thereto. An intermediate connector block 200A is secured directly to the electrical toy block 100, and a terminal connector block 200B is secured to the intermediate connector block 200A. In this manner, any number of additional toy connector blocks 200 may be secured to the electrical toy block 100 to form electrical circuits made up of various arrangements of toy blocks. For ease of illustration, FIG. 10 shows connector blocks 200 that are generally cuboidal in shape. However, connector blocks 200 may come in a wide variety of three-dimensional shapes and sizes so that electrical circuits of varying shapes and sizes may be constructed. In addition, the input and output terminal assemblies 220, 230 may be secured to connector blocks 200 in various locations on the exterior of each connector block 200.

As shown in FIG. 10, the system may further comprise an external device 240, which may be connected to the output terminal assembly 230 of the terminal connector block 200B in order to supply power to the device 240. FIG. 10 illustrates a mobile phone light 240 connected to a USB connection, though it should be understood that the external device 240 may be any electronic device that can be electrically or operably connected to the output terminal assembly 230 such that power is supplied to the device 240 from the power source 130. For instance, the external device 230 may be any type of light, a motor, a microprocessor, a fan, a Bluetooth receiver, a radio, a microphone, a speaker, an amplifier, or any similar type of electronic device. The external device 240 may also be electrically connected to an output terminal assembly 230 as shown in FIG. 9B by electrical wires connected directly to each of the output terminals.

It is understood that versions of the invention may come in different forms and embodiments. Additionally, it is understood that one of skill in the art would appreciate these various forms and embodiments as falling within the scope of the invention as disclosed herein.

What is claimed is:

1. A toy block apparatus comprising:
a housing block;
a power supply housed within the housing block; and
an external terminal assembly secured to the exterior of the housing block,
wherein the external terminal assembly comprises a first external terminal and a second external terminal each electrically connected to the power supply and each having an outer face exhibiting a magnetic polarity.

2. The toy block apparatus of claim 1, wherein the magnetic polarity exhibited by the outer face of the first external terminal is opposite of the magnetic polarity exhibited by the outer face of the second external terminal.

3. The toy block apparatus of claim 1, wherein the housing block comprises a first half and a second half.

4. The toy block apparatus of claim 3, further comprising a first internal terminal secured to an interior face of the first half and a second internal terminal secured to an interior face of the second half, and
wherein the first internal terminal is electrically connected to the power supply.

5. The toy block apparatus of claim 4, wherein the first and second internal terminals each have an outer face exhibiting a magnetic polarity, and
wherein the magnetic polarity of the outer face of the first internal terminal is opposite of the magnetic polarity of the outer face of the second internal terminal such that the first half and second half are removably secured together via magnetic attraction between the first internal terminal and the second internal terminal.

6. The toy block apparatus of claim 4, wherein the external terminal assembly comprises a first external terminal and a second external terminal each electrically connected to the power supply, and wherein the second external terminal is electrically connected to the power supply via the first and second internal terminals.

7. The toy block apparatus of claim 1, wherein the power supply is a battery.

8. The toy block apparatus of claim 1, wherein the housing block is made of wood.

9. A toy block system comprising:
a toy block apparatus comprising:
a housing block;

a power supply housed within the housing block; and an external terminal assembly secured to the exterior of the housing block, wherein the external terminal assembly is electrically connected to the power supply, and wherein the external terminal assembly is at least partially magnetized; and a connector block comprising:

a housing;

an input terminal assembly secured to the exterior of the housing of the connector block, and an output terminal assembly, wherein the output terminal assembly is electrically connected to the input terminal assembly, wherein the input terminal assembly is at least partially magnetized such that the connector block is removably secured to the housing block via magnetic attraction between the input terminal assembly and the external terminal assembly.

10. The toy block system of claim 9, further comprising an electrically-powered external device electrically connected to the output terminal assembly such that the external device is powered by the power supply.

11. The toy block system of claim 10, wherein the external device is a light.

12. The toy block system of claim 9, wherein the housing block comprises a first half and a second half.

13. The toy block system of claim 9, wherein the housing block is made of wood.

14. A method of manufacturing a toy block apparatus, said method comprising the steps of:

forming a pocket within a housing block comprising a first half and a second half by boring a first hole into an interior face of the first half and boring a second hole into an interior face of the second half, the first hole and the second hole being a diameter consistent with a diameter of a power supply to be inserted therein;

inserting the power supply into the pocket;

securing an external terminal assembly to the exterior of the housing block, wherein the external terminal assembly is at least partially magnetized; and connecting the external terminal assembly to the power supply in an electrically conductive relationship.

15. The method of claim 14, further comprising the step of:

adjoining the interior face of the first half and the interior face of the second half such that the power supply is substantially encased within the first hole and second hole.

16. The method of claim 15, wherein the first half has a first internal terminal secured to the interior face of the first half adjacent the first hole, and the second half has a second internal terminal secured to the interior face of the second half adjacent the second hole, wherein the first and second internal terminals each have an outer face exhibiting a magnetic polarity, the magnetic polarity exhibited by the outer face of the first internal terminal being opposite of the magnetic polarity exhibited by the face of the second internal terminal, and wherein the step of adjoining the interior face of the first half and the interior face of the second half comprises positioning the first half and the second half of the housing such that the magnetic attraction between the first internal terminal and the second internal terminal removably secures the first half and the second half together.

17. The method of claim 14, wherein the housing block is made of wood.

* * * * *